United States Patent [19]

Talleri

[11] 4,054,393

[45] Oct. 18, 1977

[54] SNAP-LOCKING COUPLER

[76] Inventor: Ettore Talleri, Albonago di Viganello, Switzerland

[21] Appl. No.: 676,352

[22] Filed: Apr. 12, 1976

[30] Foreign Application Priority Data

Aug. 12, 1975 Italy ..... 5198/75

[51] Int. Cl.[2] ..... F16B 7/04

[52] U.S. Cl. ..... 403/174; 403/176; 403/289; 403/406; 46/29

[58] Field of Search ..... 403/169–172, 403/174, 176, 178, 205, 218, 231, 289, 382, 401, 406, 361, 295, 302, 373; 46/28, 29; 52/753 C, 753 D, 754, 758 R, 758 C

[56] References Cited

U.S. PATENT DOCUMENTS

| | | | |
|---|---|---|---|
| 485,402 | 11/1892 | Wohlfert | 403/289 |
| 2,248,140 | 7/1941 | Trollen | 403/289 X |
| 2,406,895 | 9/1946 | Olson | 403/289 X |
| 2,909,867 | 10/1959 | Hobson | 46/29 |

FOREIGN PATENT DOCUMENTS

| | | | |
|---|---|---|---|
| 820,824 | 11/1951 | Germany | 403/231 |

*Primary Examiner*—Wayne L. Shedd

[57] ABSTRACT

A coupler is disclosed for connecting a plurality of laths of assembly of multi-component modular structures. The coupler comprises a plurality of channelled seats extending from the center of the coupler. Pins engage the bifurcated terminals of the laths, which are kept in place by said channelled seats, and may be snapped into varied structural configurations. Variants of the coupler are also described.

10 Claims, 13 Drawing Figures

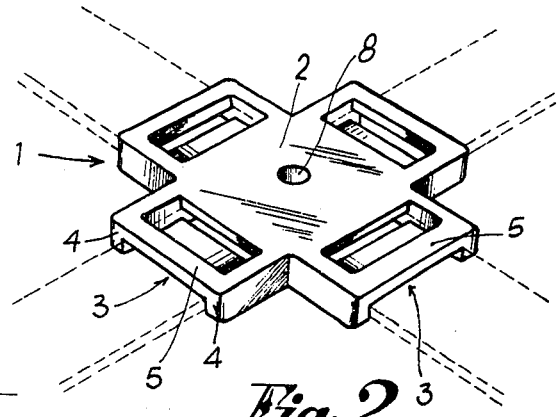
Fig. 2
Fig. 5
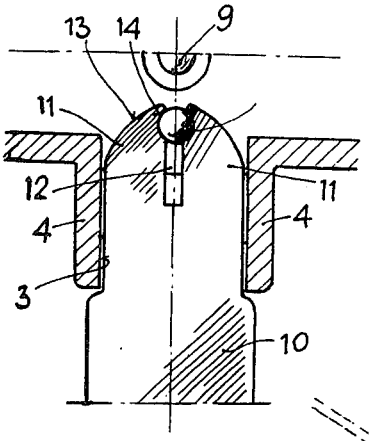
Fig. 3
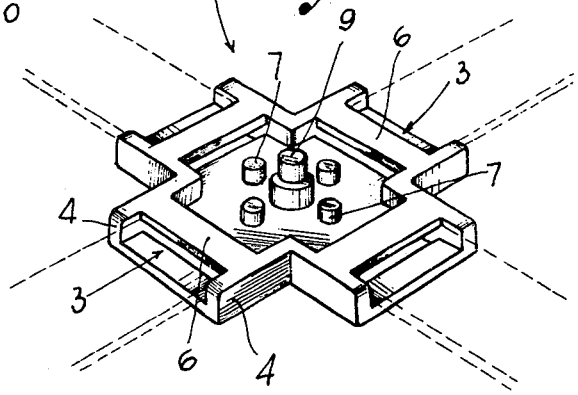
Fig. 4
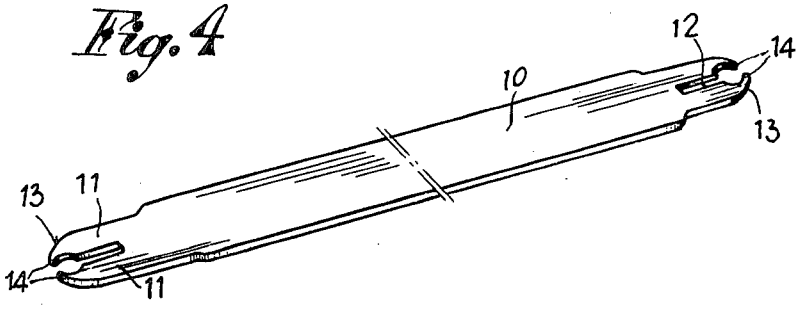

SNAP-LOCKING COUPLER

The present invention relates to couplers for connecting a plurality of laths or strips to one another so as to form a multi-component structural toy assembly, the couplers as well as the laths being preferably made of pre-stamped plastic material and the laths being optionally substantially rigid or flexible.

Pedagogical trends, especially with respect to the education of children of pre-schooling and elementary school age both in the family environment and in the classroom, suggest as a basis for the development of the child's logical reasoning power the use of so-called "structural" articles, i.e. articles intended to be manipulated and assembled into a composite structure, like a toy. The underlying pedagogical purpose is, therefore, twofold, namely it has play value for a child and it satisfies the development of the creative and intellectual capacity in a logical and rational manner.

The main object of the present invention is to achieve these pedagogical purposes by providing a coupler for a structural and readily assemblable article capable of being assembled, toylike, into a plurality of different structural configurations, the construction and complexity of which depend directly on the degree of creativity and mental development of the child.

It is an object of the invention to provide a means for obtaining said structurally varying configurations, i.e. a coupler means for connecting the individual lath members of the article in question.

Briefly stated, the coupler comprises, in a preferred embodiment, two pairs of channelled seats provided with axially positioned pins and connectable with a corresponding number of preferably flexible laths. Each lath comprises two terminal bifurcations which are connectable to the said pin through a snap-action and are insertable in said channelled seats.

According to a variant, the coupler of the invention is provided with means for the superimposition of at least another coupler so as to obtain parallel or non-parallel orientations of the channelled seats of the couplers.

By assembling a plurality of couplers and a plurality of laths into a single entity, it is possible to construct any desired structural assembly, self-supporting and of varied size and in which the couplers constitute the nodes and the laths constitute the strips branching therefrom and connecting one coupler to another.

Further understanding of the invention will become more apparent from the following detailed description thereof and from the accompanying drawings in which:

FIGS. 2 and 3 are perspective views of opposite sides of a coupler;

FIG. 4 is a perspective view of a lath;

FIG. 5 is a partial sectional view of the assembly of a coupler and a lath;

Figure 1:
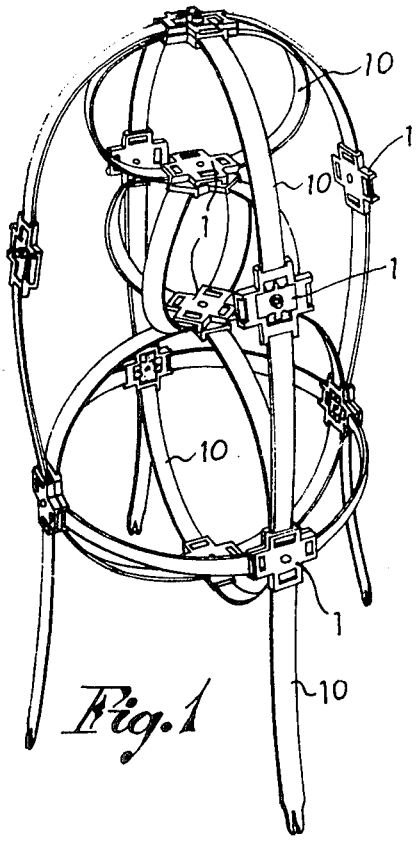
FIG. 1 is a perspective view of a typical composite structure arrived at by means of the couplers of the present invention.

Referring now to the accompanying drawings and to a preferred embodiment of the invention, the coupler, generally shown at 1, comprises a central portion 2 with two pairs of lateral channelled seats 3, one pair being positioned at right angle to the other, the seats of each pair being opposed to each other. Each seat 3 is defined by two parallel walls 4 which extend from the central portion 2, by an upper web 5 and by a lower transverse web 6, the webs being spaced from each other and not aligned in the same plane. On the lower surface of the central portion 2 and axially positioned with respect to each seat 3 there is provided a pin 7. On the central portion 2 and in the upper surface thereof there is provided an opening 8, while on the opposite or lower surface of seat 3 there is provided a pin 9 of diameter corresponding with that of opening 8.

Each channelled seat 3 is associated to a lath member 10, made preferably of pre-stamped plastic-material, preferably flexible. Lath 10 comprises two bifurcated terminals, each bifurcation 11 being defined by an intermediate slot 12 which enables the bifurcations 11 to flex apart from each other. A lateral bevel 13 is provided in each bifurcation 11 along with a beak 14. The beaks of the two bifurcations form a pair of pincers which serve the purpose of engaging the pin 7 of a coupler.

The lath 10 is connected to a coupler by sliding one terminal of the lath through the channelled seat 3 of the coupler and to snap engage the pincers 14 to the pin 7, as shown clearly in detail in FIG. 5 of the drawings. The snap engagement is possible due to the flexibility of the bifurcations 11 which during the engagement with the pin 7 spread apart to return soon thereafter to their original position, when the pin 7 is within the pincers 14 of the lath 10.

It can therefore be appreciated that up to four laths may be connected to a coupler to protrude therefrom at 90° from each other, each lath being longitudinally held by the corresponding channelled seat 3. If a flexible lath is used, each lath 10 may be arc-like bent as shown in FIG. 1 and may be connected at the other extremity thereof to a second coupler which is not aligned with the first coupler, thus forming spherical and other convoluted configurations.

Figure 6:
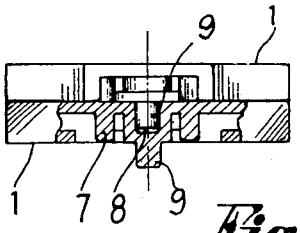
FIG. 6 is a partial sectional view of the assembly of two couplers.
Figure 7:
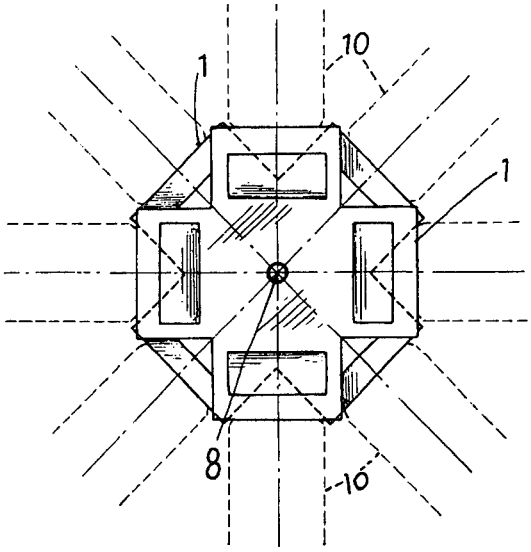
FIG. 7 is a plan view of two superposed and differently oriented couplers.

Furthermore, a coupler may be superimposed to a second one simply by engaging the central pin 9 of the upper coupler with the opening 8 of the lower coupler — see FIG. 6 —, so that the superimposed couplers may be so arranged that their channelled seats may be oriented in the same parallel direction or may be oriented differently as shown, for example, in FIG. 7. Consequently, also the laths connected thereto are oriented either parallel to one another or not parallel. The assembly of several couplers, all similar to one another, and of several laths, either of the same length or of different lengths, will result in a great variation of structural combinations, the size and shape of which depend on the orientation of the component parts and on the ingenuity of the user.

Figure 8:
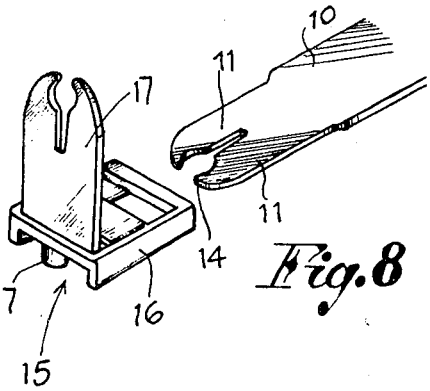
FIG. 8 is a perspective view of a variant coupler for assembly with a lath at right angle thereto.
Figure 9:
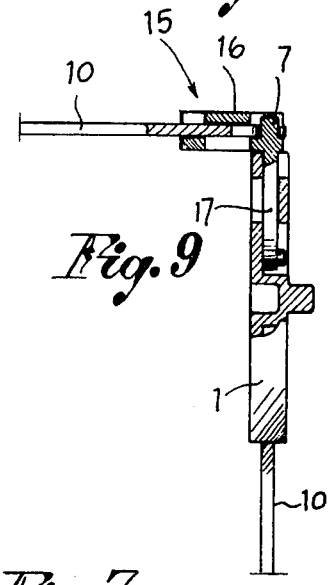
FIG. 9 is a partial sectional view of a lath assembled to the coupler of FIG. 8.

In FIG. 8 of the drawings there is shown a variant coupler 15 which may be positioned between coupler 1 and anyone lath 10 so as to enable the connection of the lath 10 not in alignment with the corresponding channelled seat of the coupler 1, but perpendicularly thereto so that the lath 10 is at 90° with the coupler 1. This coupler 15 comprises essentially a first portion 16 having all the features of coupler 1 and suitable to engage one terminal of a lath 10, and a second portion 17 positioned perpendicularly to the first portion and having all the features of the terminal of a lath and suitable to engage by snap action the pin of another coupler 1, as shown clearly in FIG. 9.

By means of this hybrid coupler 15 the possibilities of assembly are increased even more so that the ingenuity of the child user is further challenged in the realm of artistic creativity.

Figure 10:
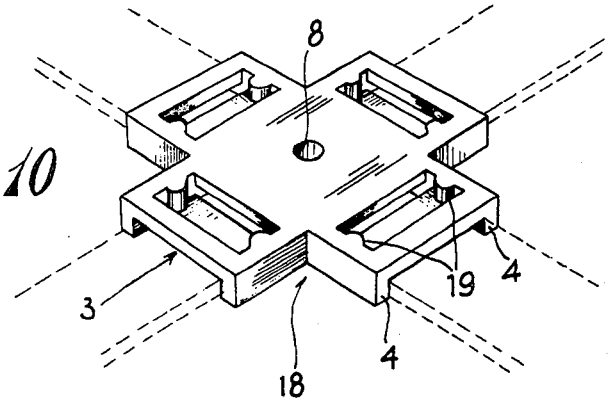
FIGS. 10 & 11 are perspective views of constructional variants of the coupler of the invention, taken from opposite sides.
Figure 11:
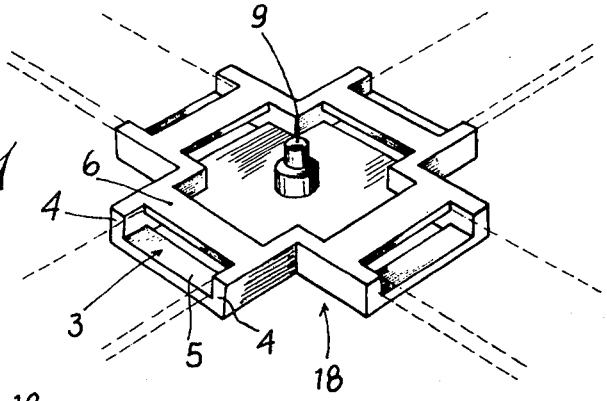
Figure 12:
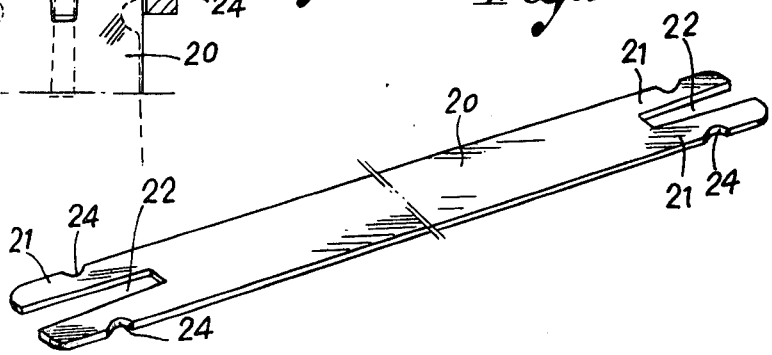
FIG. 12 is a perspective view of a lath usable with the coupler of FIGS. 10 & 11.

According to a variant represented graphically in FIGS. 10, 11 and 12, the coupler 18, instead of having the heretofore described pins 7, is provided with a pair of tappets 19, opposite to each other and positioned on the inner surfaces of the parallel edges 4 of each channelled seat 3. Similarly, the lath 20 is provided with two bifurcated terminals, the branches 21 of which are defined by an intermediate slot 22 and have a pair of lateral external intermediate notches 24.

Figure 13:
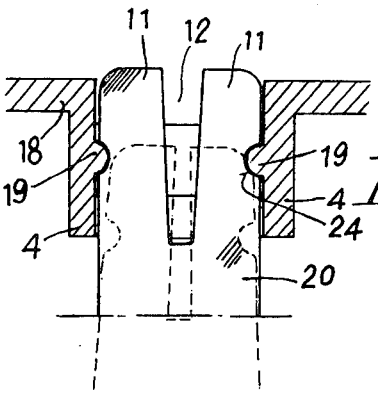
FIG. 13 is a partial sectional view of the assembly of the lath of FIG. 12 with the coupler of FIGS. 10 & 11.

The engagement of lath 20 to the coupler 18 is obtained by placing one terminal of the bifurcated lath within the channelled seat 3 of the coupler and by snapping the tappets 19 in juxtaposition with the corresponding notches 24, as shown clearly in FIG. 13 of the drawings.

It is to be understood that the above described invention is susceptible of conventional modifications without departing from the scope of the invention. For example, the coupler may be provided with less than or more than four channelled seats and oriented differently than hereabove described.

What is claimed is:

1. A multi-component assembly comprising a coupler having upper and lower surfaces and a plurality of channelled seats extending from the center thereof; at least one projection integral with each said seat; and a plurality of elongated laths having a flexible bifurcated terminal at each end thereof and removably slidable in said respective channelled seat for engagement under snap pressure with said respective projection.

2. The assembly of claim 1, wherein said channelled seat is defined by a pair of parallel walls, extending from the central portion of said coupler, by an upper transverse web and by a lower transverse web, each said transverse web connecting respectively said parallel walls.

3. The assembly of claim 2 wherein said projections are pins that are located on the lower surface of said central portion, the axes of said pins being perpendicular to the plane of said inner surface.

4. The assembly of claim 1, wherein the terminal of said lath comprises a bifurcated end defined by an intermediate slot and a beak that forms a pincer so that each bifurcation is rendered flexible and permits the snap-action engagement of the lath with said projection.

5. The assembly of claim 1, wherein the center of said coupler is provided with a central opening on one surface thereof and a central pin on the opposite surface thereof and in alignment with said opening whereby said central pin of one said coupler is adapted to be received in said central opening of another of said couplers.

6. The assembly of claim 1, wherein there is further included a bifurcated terminal of a lath integral with said coupler, the plane of said bifurcated terminal being perpendicular to the plane of said seat whereby said integral terminal is removably slidable in the channelled seat of another one of said couplers.

7. The assembly of claim 1, wherein said channelled seats are oriented in different directions.

8. The assembly of claim 1, wherein said projection in said seat is defined by a pair of tappets positioned opposite to each other on the lateral inner surfaces of said channelled seat, and wherein said bifurcated terminal of said lath is provided with a notch on each longitudinal side edge thereof for juxtaposed engagement with said tappet.

9. The assembly of claim 1 wherein said projection in said seat is defined by a tappet positioned on one of the lateral inner surfaces of said channelled seat, and wherein said bifurcated terminal of said lath is provided with a notch on one of the longitudinal side edges thereof for juxtaposed engagement with said tappet.

10. The assembly of claim 1 wherein said lath is flexible along the entire length thereof.

* * * * *